United States Patent [19]

Duruz et al.

[11] Patent Number: 4,614,569

[45] Date of Patent: Sep. 30, 1986

[54] MOLTEN SALT ELECTROWINNING METHOD, ANODE AND MANUFACTURE THEREOF

[75] Inventors: Jean J. Duruz, Geneva; Jean-Pierre Derivaz, Petit Saconnex; Pierre-Etienne Debely; Iudita L. Adorian, both of Geneva, all of Switzerland

[73] Assignee: Eltech Systems Corporation, Boca Raton, Fla.

[21] Appl. No.: 644,726

[22] PCT Filed: Jan. 13, 1984

[86] PCT No.: PCT/EP84/00010

§ 371 Date: Aug. 20, 1984

§ 102(e) Date: Aug. 20, 1984

[87] PCT Pub. No.: WO84/02724

PCT Pub. Date: Jul. 19, 1984

[30] Foreign Application Priority Data

Jan. 14, 1983 [GB] United Kingdom ..... 8301001

[51] Int. Cl.[4] ..... C25C 3/00; C25C 3/06; C25C 3/12; C25C 3/18

[52] U.S. Cl. ..... 204/67; 204/64 R; 204/39; 204/64 T; 204/65; 204/68; 204/69; 204/70; 204/290 R; 204/291

[58] Field of Search ..... 204/64 R, 64 T, 67, 204/70, 291, 294, 65, 68, 69, 243 R, 39, 290 R

[56] References Cited

U.S. PATENT DOCUMENTS

| | | | |
|---|---|---|---|
| 3,562,135 | 2/1971 | Marincek | 204/243 |
| 3,578,580 | 5/1971 | Hatting et al. | 204/243 |
| 3,692,645 | 9/1972 | Marincek | 284/67 |
| 4,146,438 | 3/1979 | de Nora et al. | 204/1.5 |
| 4,173,518 | 11/1979 | Yamada et al. | 204/67 |
| 4,187,155 | 2/1980 | de Nora et al. | 204/67 |
| 4,192,724 | 3/1980 | Minami et al. | 204/67 |

*Primary Examiner*—Howard S. Williams
*Attorney, Agent, or Firm*—John J. Freer

[57] ABSTRACT

A method of electrowinning a metal such as aluminum from e.g. a cryolite based melt containing alumina employs an enode having as its operative surface a protective coating which is maintained by the presence of constituents of the coating dissolved in the melt. The protective coating is preferably a fluorine-containing cerium oxycompound electro-deposited in-situ from cerium species dissolved in a fluoride-based melt.

32 Claims, No Drawings

MOLTEN SALT ELECTROWINNING METHOD, ANODE AND MANUFACTURE THEREOF

TECHNICAL FIELD

The invention relates to the electrowinning of metals from molten salt electrolytes as well as to molten salt electrolysis anodes and methods of manufacturing these anodes.

BACKGROUND ART

Electrowinning of metals from molten salt electrolytes involves numerous difficulties. A typical process is the production of aluminum by the Hall-Heroult process which involves the electrolysis of alumina in a molten cryolite-based bath usng carbon anodes. These carbon anodes are consumed by the anodic oxidation process with the formation of CO2/CO and their lifetime is very short, typically about two to three weeks for the pre-baked type or anode. They may also add impurities to the bath. There have been numerous suggestions for non-consumable anode compositions based on various ceramic oxides and oxycompounds usually with added electro-conductive agents and electrocatalysts. Many difficulties have been encountered in practice with such anodes, the major difficulty being that the anodes are invariably consumed more or less slowly and undesirably contaminate the molten bath and the aluminum or other metal produced.

For example, U.S. Pat. Nos. 4,146,438 and 4,187,155 describe molten-salt electrolysis anodes consisting of a ceramic oxycompound matrix with an oxide or metallic conductive agent and a surface coating of an electrocatalyst e.g. oxides of cobalt, nickel, manganese, rhodium, iridium, ruthenium and silver. One of the problems with these electrodes is that the catalytic coating wears away.

Another approach, described in U.S. Pat. Nos. 3,562,135, 3,578,580 and 3,692,645, was to separate the anode and cathode by an oxygen-ion conducting diaphragm, typically made of stabilized zirconium oxide or other refractory oxides with a cubic (fluorite) lattice, including thorium oxide/uranium oxide and cerium oxide suitably stabilized with calcium oxide or magnesium oxide. In one arrangement, the ion-conductive diaphragm was applied to the operative anode surface which was either liquid or was porous, perforated or reticulated and provided with means for releasing the oxygen generated at the anode under the diaphragm. This involved considerable problems in anode design and in manufacture of the composite anode/diaphragm. Another arrangement was to separate the diaphragm from the anode surface; here, it would appear that tests failed to identify any feasible diaphragm material.

DISCLOSURE OF INVENTION

According to one of the main aspects of the invention, as set out in the claims, a method of electrowinning metals and typically the electrowinning of aluminum from a cryolite-based melt containing alumina, is characterized in that the anode dipping in the molten electrolyte has as its operative surface a protective coating which is maintained by the presence of constituents of the coating dissolved in the melt, usually with substantially no cathodic deposition of said constituents.

Generally, cerium is dissolved in the a fluoride melt and the protective coating is predominantly a fluorine-containing oxycompound of cerium. When dissolved in a suitable molten electrolyte, cerium remains dissolved in a lower oxidation state but, in the vicinity of an oxygen-evolving anode, oxidizes in a potential range below or at the potential of oxygen evolution and precipitates as a fluorine-containing oxycompound which remains stable on the anode surface. It has been found that the thickness of the electrodeposited fluorine-containing cerium oxycompound coating can be controlled as a function of the amount of the cerium introduced in the electrolyte, so as to provide an impervious and protective coating which is electronically conductive and functions as the operative anode surface, i.e. usually an oxygen evolving surface. Furthermore, the coating can be self-healing or self-regenerating and can be maintained permanently by having a suitable concentration of cerium in the electrolyte.

The term fluorine-containing oxycompound is intended to include oxyfluoride compounds and mixtures and solid solutions of oxides and fluorides in which fluorine is uniformly dispersed in an oxide matrix. Oxycompounds containing about 5–15 atom % of fluorine have shown adequate characteristics including electronic conductivity; however these values should not be taken as limiting.

It is understood that the metal being electrowon will necessarily be more noble than the cerium (Ce 3+) dissolved in the melt, so that the desired metal deposits at the cathode with no substantial cathodic deposition of cerium. Such metals can be chosen from group Ia (lithium, sodium, potassium, rubidium, cesium), group IIa beryllium, magnesium, calcium, strontium, barium), group IIIa (aluminum, gallium, indium, thallium), group IVb (titanium, zirconium, hafnium), group Vb (vanadium, niobium, tantalum) and group VIIb (manganese, rhenium).

Also, the concentration of the cerium ions dissolved in the lower valency state in the electrolyte will usually be well below the solubility limit in the melt. For example, when up to 2% by weight of cerium is included in a molten cryolite-alumina electrolyte, the cathodically won aluminum will contain only 1–3% by weight of cerium. This can form an alloying element for the aluminum or, if desired, can be removed by a suitable process.

The protective coating formed from cerium ions (Ce 3+) dissolved in the melt consists essentially of fluorine-containing ceric oxide. When produced from a cryolite melt, this coating will consist essentially of fluorine-containing ceric oxide with inclusions of minor quantities of electrolyte and compounds such as sodium fluoride (NaF) and complex fluoro-compounds such as $NaCeF_4$ and $Na_7Ce_6F_{31}$. It has been found that the coating thus provides an effective barrier shielding the substrate from the corrosive action of molten cryolite.

Various cerium compounds can be dissolved in the melt in suitable quantities, the most usual ones being halides (preferably fluorides), oxides, oxyhalides, sulfides, oxysulfides and hydrides. However, other compounds can be employed. These compounds can be introduced in any suitable way to the melt before and/or during electrolysis.

It is possible and advantageous to deposit the protective coating in situ in the melt, e.g. in an aluminum electrowinning cell. This is done by inserting a suitable anode substrate in the fluoride-based melt which contains a given concentration of cerium. The protective coating then builds up and forms the operative anode surface. The exact mechanism by which the protective coating is formed is not known; however, it is postulated that the cerium ions are oxidized to the higher oxidation state at the anode surface to form a fluorine-containing oxycompound which is chemically stable on the anode surface. Of course, the anode substrate should be relatively resistant to oxidation and corrosion during the initial phase of electrolysis until the electrodeposited coating builds up to a sufficient thickness to fully protect the substrate. Also, when a protective coating is formed in situ in the electrowinning cell in this manner, it will be desirable to keep a suitable concentration of cerium in the electrolyte to maintain the protective coating and possibly compensate for any wear that could occur. This level of the cerium concentration may be permanently monitored, or may simply be allowed to establish itself automatically as an equilibrium between the dissolved and the electrodeposited species.

The anode substrate inserted into the melt may contain or be pre-coated with cerium as metal, alloy or intermetallic compound with at least one other metal or as compound. A stable fluorine-containing oxy-compound coating can thus be produced by oxidation of the surface of a cerium-containing substrate by an in situ electrolytic oxidation as described, or alternatively by a pre-treatment.

Another main aspect of the invention consists of a method of electrowinning metals from a molten-salt electrolyte in which the anode dipping into the melt has as its operative surface an anodically active and electronically conductive coating of at least one fluorine-containing oxycompound of cerium. This is based on the fact that such a coating, when pre-applied to the electrode substrate by electrodeposition or otherwise, remains stable on the anode surface during operation whereby long anode lifetimes can be achieved possibly without the need to add a low concentration of cerium ions to the electrolyte.

The invention also extends to a molten salt electrolysis anode comprising an electrically conductive body having an anodically active and electronically conductive surface of a fluorine-containing oxycompound of cerium. Preferably, the surface will be an electrodeposited coating of a fluorine-containing cerium oxycompound. A dense electrodeposited coating consisting essentially of fluorine-containing ceric oxide is preferred.

The anode body or substrate may be composed of a conductive ceramic, cermet, metal, alloy, intermetallic compound and/or carbon. When the active oxycompound is electrodeposited from a melt in oxygen-evolution conditions, the substrate should be sufficiently stable at the oxygen-evolution potential for initiation of the protective coating. Thus, for example, if an oxydizable metal or metal alloy substrate is used it is preferably subjected to a preliminary surface oxidation in the electrolyte or prior to insertion in the electrolyte. Also, a carbon substrate could be precoated with a layer of conductive ceramic, cermet, metal, alloy or intermetallic compound. In some cases, the anode body could include cerium and/or compounds thereof.

The protective coating on the anode will often consist of the fluorine-containing cerium oxycompound and at least one other material. This includes materials which remain stable at the anode surface and form a permanent component of the coating during operation. Materials which improve the electronic conductivity or electrocatalytic characteristics of the coating will be preferred.

A preferred method according to the invention for forming the protective coating on the anode is to insert the anode substrate in a fluoride-based molten salt electrolyte containing a suitable quantity of cerium and pass current to electrodeposit a fluorine-containing cerium oxycompound.

Preliminary tests in conditions simulating the industrial electrowinning of aluminum from a cryolite-based melt containing alumina have demonstrated that this method of coating the electrode can be achieved under normal cell operating conditions (anode current density, electrolyte composition and temperature etc., but with the addition of an appropriate quantity of cerium). Thus, the anode coating method may be carried out in industrial electrowinning cells under normal operating conditions. Alternatively, the coating layer can be produced in the electrowinning cell in a special preliminary step with conditions (anode current density at steady current or with pulse-plating etc.) selected to produce an optimum electrodeposited coating. Once the coating has been deposited under optimum conditions, the cell can be operated under the normal conditions for the metal being won. Yet another possibility is to electroplate the coating outside the electrowinning cell, usually with specially chosen conditions to favour particular characteristics of the coating.

Other methods of applying the operative anodic coating (or an undercoating which is to be built up in use) include for example plasma or flame spraying, vapor deposition, sputtering, chemideposition or painting of the coating material to produce a coating consisting predominantly of one or more cerium oxycompounds, which may be an electronically conductive and anodically active fluorine-containing oxycompound such as cerium oxide/fluoride. Such methods of producing the coating before inserting the anode in the molten electroyte may be preferred for coatings incorporating certain additives and for cerium oxycompound coatings which can incorporate fluorine during exposure to the fluoride electrolyte. Also, a coating produced this way can be consolidated or maintained by electrodeposition of the fluorine-containing cerium oxycompound in situ in the electrowinning cell, by having a chosen quantity of cerium ions present in the molten fluoride-containing electrolyte.

The invention will be further illustrated by the following example:

EXAMPLE

A laboratory aluminum electrowinning cell was operated with a cryolite electrolyte containing 10% by weight of alumina and different concentrations of cerium compounds. For some runs the electrolyte was based on natural cryolite of 98% purity with the usual fluoride/oxide impurities, and for other runs electrolyte recovered from an industrial aluminum production cell was used. The additive was ceric oxide ($CeO_2$) or cerium fluoride ($CeF_3$) in concentrations ranging from 0.5–2% by weight of the electrolyte. The cathode was a pool of molten aluminum, and various anode substrates of cylindrical and square cross-section were used suspended in the electrolyte, namely: palladium; tin dioxide (approx. composition SnO2 98.5%, Sb2O3 1%, CuO 0.5%, 30 vol % porosity); and a nickel-chrome alloy, 80–20 wt%. Electrolysis was carried out at 1000° C. at an anode current density of approx. 1A/cm2. The duration of electrolysis ranged from 6 hours to 25 hours.

At the end of electrolysis, the anode specimens were removed and inspected. On the palladium and tin dioxide substrates was an adherent, dense and coherent electrodeposited coating. Microscopic examination revealed a columnar structure which was essentially nonporous but contained inclusions of a second phase. Analysis of the coating by X-ray diffraction and microprobe revealed the presence of a major phase of fluorine-containing ceric oxide (possibly containing some cerium oxyfluoride CeOF) with a minor amount of NaF, $NaCeF_4$ and/or $Na_7Ce_6F_{31}$. Traces of cryolite were also detected. The fluorine-containing ceric oxide always accounted for more than 95% by weight of the coating. Quantitative analysis of the major phase of cerium oxide/fluoride gave a typical composition, in atomic percent, of 51.3% cerium, 39.5% oxygen and 9.2% fluorine. The coating thickness ranged from about 0.5 to 3 mm and was found to be independent of the electrolysis duration, but increased with the quantity of cerium added to the melt. Monitoring of the voltage during electrolysis showed that the coated anodes were operating to evolve oxygen.

Initially, no deposit was obtained on the nickel-chrome alloy specimen. However, when the alloy surface was subjected to a pre-oxidation treatment, an electrodeposited coating was obtained, as discussed above.

The cathodic current efficiency was typically 80–85% and the electrowon aluminum contained about 1–3% by weight of cerium.

We claim:

1. A method of electrowinning a metal by the electrolysis of a melt containing dissolved species of the metal to be won using an anode immersed in the melt, characterized in that the operative anode surface has a complex, inorganic protective coating containing metal in non-elemental form, with the metal of the complex being other than the metal to be won, which complex protective coating is maintained by the presence of constituents of the coating dissolved in the melt including the metal of the complex at a concentration well below its solubility limit in the melt.

2. The method of clam 1, wherein cerium is dissolved in a fluoride-containing melt and the protective coating is predominantly a fluorine-containing cerium oxycompound.

3. The method of claim 2, wherein the protective coating consists essentially of fluorine-containing ceric oxide.

4. The method of claim 2 or 3, wherein at least one fluoride, oxide, oxyfluoride, sulfide, oxysulfide or hydride of the cerium is dissolved in the melt.

5. The method of claim 3, wherein the protective coating is electro-deposited in situ.

6. The method of claim 3, wherein an anode substrate containing or precoated with cerium as metal, alloy or intermetallic compound with at least one other metal, or as compound is immersed in the melt.

7. A method of electrowinning a metal by the electrolysis of a melt containing dissolved species of the metal to be won using an anode immersed in the melt, characterized in that the anode has as its operative surface an anodically active and electronically conductive coating of at least one fluorine-containing oxycompound of cerium.

8. The method of claim 7 for the electrowinning of aluminium from a cryolite-based melt containing alumina.

9. A molten salt electrolysis anode comprising an electrically conductive body having an anodically active and electronically conductive surface of at least one fluorine-containing oxycompound of cerium.

10. The anode of claim 9, wherein the surface is composed of an electrodeposited coating.

11. The anode of claim 10, wherein the coating is a dense electrodeposited coating consisting essentially of fluorine-containing ceric oxide.

12. The anode of claim 9, 10 or 11, wherein the anode body is composed of a conductive ceramic, cermet, metal, alloy, intermetallic compound and/or carbon.

13. The anode of claim 12, wherein the anode body is a carbon substrate coated with a layer of conductive ceramic, cermet, metal, alloy or intermetallic compound.

14. The anode of claim 9, wherein the anode body includes cerium, compounds thereof, or mixtures of the foregoing.

15. The anode of claim 9, wherein the coating consists of at least one fluorine-containing cerium oxycompound and at least one other material.

16. The anode of claim 15 wherein said other material is selected from the group consisting of electrolyte for said molten salt electrolysis, NaF, complex fluoro-compounds and mixtures thereof.

17. The anode of claim 16, wherein said complex fluoro-compounds are $NaCeF_4$, $Na_7Ce_6F_{31}$, and their mixtures.

18. A method of producing the anode body of claim 9, comprising inserting the anode body in a fluoride containing molten salt electrolyte containing cerium and passing current to electrodeposit a fluorine-containing oxycompound of cerium.

19. The method of claim 18, wherein the molten salt electrolyte is a cryolite-based melt containing alumina.

20. The method of claim 19, which is carried out in situ in an aluminum production cell.

21. A method of producing the anode of claim 9, wherein a coating of the fluorine-containing cerium oxycompound is applied to the anode body prior to inserting the anode into a molten electrolyte.

22. The anode of claim 9 wherein said fluorine-containing oxycompound of cerium contains CeOF.

23. The anode of claim 9 wherein said surface has a major phase of cerium oxide/fluoride composition in atomic proportion corresponding at least substantially to the formula $Ce_{51.3}O_{39.5}F_{9.2}$.

24. An anode especially adapted for molten salt electrolysis, said anode comprising an anodically active and electronically conductive surface of at least one fluorine-containing oxycompound of a metal in mixture with at least one complex fluoro-compound.

25. The anode of claim 24 wherein the metal of said fluorine-containing oxycompound is also present in said complex fluoro-compound.

26. The anode of claim 25 wherein said metal is cerium.

27. The anode of claim 24 wherein said fluorine-containing oxycompound includes CeOF and said complex fluoro-compound contains cerium plus alkali metal.

28. The anode of claim 24 wherein said complex fluoro-compound includes $NaCeF_4$, $Na_7Ce_6F_{31}$ and their mixtures.

29. The anode of claim 24 wherein said surface also includes alkali metal fluoride.

30. The method of electrowinning a metal more noble than cerium by electrolysis of a melt containing dissolved species of the metal to be won using an anode immersed in the melt, characterized in that the operative anode surface has a complex inorganic protective coating containing cerium in non-elemental form, which is maintained by the presence of constituents of the coating dissolved in the melt.

31. The method of claim 30 wherein cerium is dissolved in the melt at a concentration well below its solubility limit in said melt.

32. The method of claim 30 wherein said metal to be won is selected from the group consisting of Group Ia, Group IIa, Group IIIa, Group IVb, Group Vb, and Group VIIb metals, as well as from their mixtures where such exist for electrowinning.

* * * * *